United States Patent [19]

Wilson

[11] Patent Number: 4,733,841

[45] Date of Patent: Mar. 29, 1988

[54] HANGER BRACKET FOR CABINET

[75] Inventor: Harold R. Wilson, Holland, Mich.

[73] Assignee: Haworth, Inc., Holland, Mich.

[21] Appl. No.: 894,970

[22] Filed: Aug. 8, 1986

[51] Int. Cl.[4] ..... E04G 3/00

[52] U.S. Cl. ..... 248/222.1; 108/108; 211/103; 211/135; 211/187; 248/225.2; 248/243; 248/247; 312/245

[58] Field of Search ..... 248/225.2, 222.1, 221.3, 248/243, 247; 211/187, 192, 135, 103; 312/242, 245; 108/108, 109

[56] References Cited

U.S. PATENT DOCUMENTS

| | | | |
|---|---|---|---|
| 857,543 | 6/1907 | Thomas . | |
| 977,609 | 12/1910 | Freeman . | |
| 2,127,280 | 8/1938 | Zimbalist . | |
| 3,273,847 | 9/1966 | Berman . | |
| 3,299,839 | 1/1967 | Nordbak . | |
| 3,601,432 | 8/1971 | Fenwick et al. . | |
| 3,612,290 | 8/1969 | Evans . | |
| 3,697,034 | 1/1970 | Shell . | |
| 3,895,774 | 7/1975 | Sharp . | |
| 3,996,158 | 6/1976 | Boundy . | |
| 4,048,768 | 9/1977 | Good . | |
| 4,222,542 | 9/1980 | Wilson et al. | 248/221.3 X |
| 4,324,379 | 4/1982 | Ovitz, III | 248/222.1 |
| 4,371,083 | 2/1983 | Zingrini et al. | 211/187 X |
| 4,387,872 | 6/1983 | Hogue | 248/221.3 |
| 4,401,222 | 8/1983 | Kulikowski et al. | 211/94 |
| 4,560,072 | 12/1985 | Burrell | 312/245 X |

FOREIGN PATENT DOCUMENTS

| | | | |
|---|---|---|---|
| 599826 | 11/1959 | Italy | 108/108 |
| 751485 | 6/1956 | United Kingdom | 248/222.1 |
| 2042876 | 10/1980 | United Kingdom | 108/108 |

*Primary Examiner*—J. Franklin Foss
*Assistant Examiner*—David L. Talbott
*Attorney, Agent, or Firm*—Flynn, Thiel, Boutell & Tanis

[57] ABSTRACT

A hanger bracket for attaching a furniture component to an upright wall. The component has end panels each provided with a substantially identical bracket adapted for engagement with slots formed in an upright. The bracket is formed in one piece of a thin sheetlike metal plate which is oriented vertically closely adjacent the respective end panel. The bracket has a forward end fixed to the end panel, and a cantilevered spring part which projects rearwardly adjacent the end panel in sidewardly spaced relationship so that it can be sidewardly resiliently deflected. This spring part, at the rearward edge thereof, has L-shaped hooks projecting rearwardly for engagement with the respective slotted upright. The spring part also has a locking finger integrally associated therewith adjacent the free edge thereof, which locking finger has a rearwardly protruding hose which registers with and projects into one of the slots only when the hooks are seated on the upright.

13 Claims, 5 Drawing Figures

HANGER BRACKET FOR CABINET

FIELD OF THE INVENTION

This invention relates to an improved hanger bracket for attaching a furniture component, such as a cabinet, to a slotted upright associated with a wall structure.

BACKGROUND OF THE INVENTION

Shelves and the like have conventionally been supported on slotted uprights by utilizing brackets which employ a plurality of vertically spaced, L-shaped hooks which project through a plurality of spaced slots in the upright. This basic bracket-upright arrangement cooperates in a desirable manner to provide both strength and convenience of assembly.

U.S. Pat. No. 4,222,542, owned by the Assignee of this application, illustrates therein a bracket arrangement of the aforementioned type for permitting a furniture component to be mounted in a cantilevered relationship adjacent the vertical face of a wall panel, which panel has slotted uprights adjacent the opposite vertical edges thereof for cooperation with brackets which are secured to and project rearwardly from the furniture component adjacent opposite ends thereof. The bracket arrangement of the aforementioned patent additionally incorporates a locking element which is formed as a cantilevered spring and which engages one of the slots in the upright when the bracket is properly seated so as to prevent accidental dislodgement of the bracket from the upright.

While the arrangement of the aforementioned patent has been extensively utilized and proven to perform in a highly satisfactory manner, nevertheless this prior arrangement, together with many other conventional bracket arrangements of this general type, have still possessed features which have been less than optimum. For example, when bracket arrangements of the aforementioned type are provided adjacent opposite ends of the furniture component for cooperation with a pair of parallel slotted uprights, the brackets are conventionally fixedly secured to and project rearwardly of the component and hence have a predetermined sideward spacing therebetween. The slotted uprights similarly have a predetermined sideward spacing therebetween inasmuch as they are fixedly associated with opposite edges of a wall panel. Due to the narrowness of the slot into which the hooks on the brackets project, however, it has been discovered that in some instances it is difficult to properly align the brackets on opposite ends of the component with the pair of slotted uprights. Due to standard manufacturing tolerances, coupled with other variations such as load distortion and the like, it is sometimes difficult to mount the component on the panel due to the inability to properly align the sidewardly spaced brackets with the slots in the sidewardly spaced uprights.

In addition, prior furniture components employing brackets of this type have generally not only had the brackets rigidly secured thereto in relationship to the housing of the component, but in addition the bracket arrangement has typically employed a pair of separate upper and lower bracket members associated with each end of the component for cooperation with the respective slotted upright. These separate bracket members are generally rigidly secured to the component, as by screws, and hence the use of two separate brackets at each end of the component not only increases the number of parts and hence the manufacturing and assembly complexity, but also increases the tolerance variations and hence possible misalignment problems.

Accordingly, it is an object of this invention to provide an improved hanger bracket arrangement for a furniture component which overcomes the aforementioned disadvantages and which greatly facilitates the mounting of the furniture component on a pair of slotted uprights as associated with a wall structure.

More specifically, in the present invention there is provided an improved bracket arrangement which includes a pair of hanger brackets which mount adjacent the opposite ends of a furniture component and which project rearwardly thereof for engagement with a pair of sidewardly-spaced slotted uprights. One of the hanger brackets (and preferably both) has capability of limited sideward displacement relative to the component and relative to the other hanger bracket so as to permit the sideward spacing of the hanger brackets to be easily slightly varied during mounting of the component on the uprights so as to facilitate the mounting procedure.

A further object is to provide an improved bracket arrangement, as aforesaid, which employs a bracket which is formed substantially as a cantilever spring plate so as to permit the rearward hook portion of the bracket to be normally maintained in a selected position relative to the component while at the same time permitting limited resilient deflection thereof in either sideward direction to facilitate engagement of the bracket with the slotted upright.

A still further object is to provide an improved bracket arrangement, as aforesaid, which includes a single bracket member constructed of a thin sheetlike metal plate associated with each end panel of the furniture component, with each bracket member having vertically spaced upper and lower parts which are integrally associated with the same plate and cooperate with the same slotted upright, with this bracket plate also having an integral locking structure associated therewith intermediate the upper and lower bracket parts for engagement with the slotted upright when the bracket member is properly seated thereon to prevent accidental dislodgement.

Still a further object is to provide an improved bracket arrangement, as aforesaid, which is particularly desirable for use with a cabinet-type furniture component constructed of thin sheetlike metal plates since the bracket member can be similarly formed from a single such plate and then secured, as by spot welding, to the metal plates defining the end panels of the component. The improved arrangement of this invention provides for economical manufacture and assembly of the component, and provides increased ease of mounting the component on a wall panel.

Other objects and purposes of the invention will be apparent to persons familiar with structures of this general type upon the reading the following specification and inspecting the accompanying drawings.

DETAILED DESCRIPTION

Figure 1:
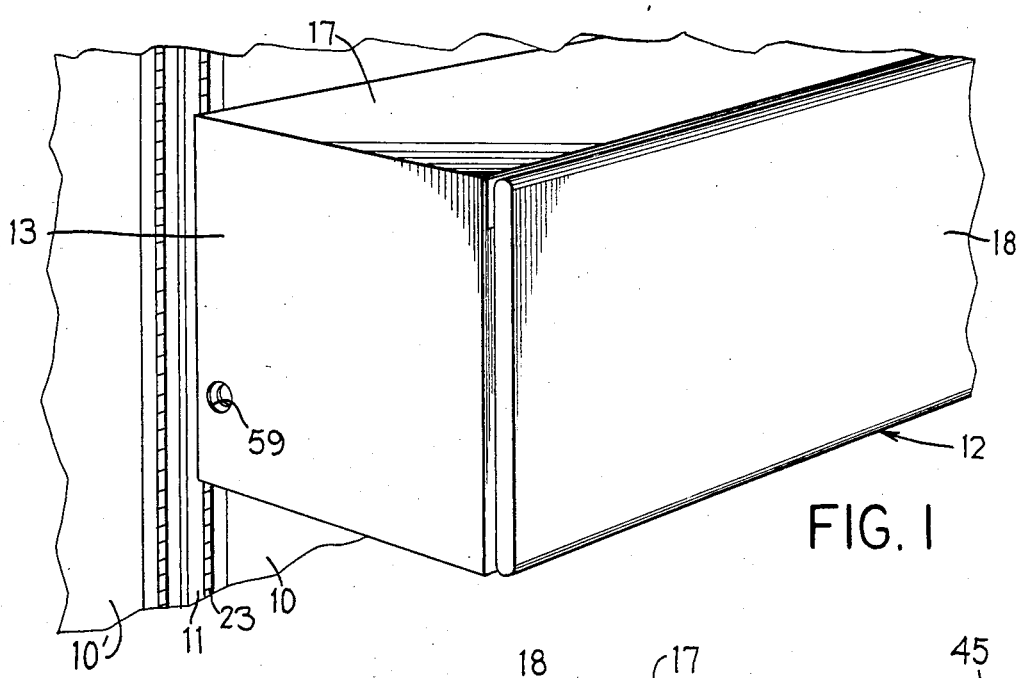
FIG. 1 is a fragmentary perspective view illustrating a conventional furniture component, such as a closed storage cabinet, mounted in a cantilevered fashion on one side of a series-connected space-divider wall panel.

FIG. 1 illustrates a pair of substantially identical, portable, upright space-divider wall panels 10 and 10' which have their adjacent edges horizontally connected in series. The structure of these panels, and their usage in offices and the like, is well known.

The panel 10 has a pair of slotted uprights 11 disposed adjacent the opposite vertical edges thereof. A shelflike furniture component 12 is attached to the panel 10, as by being connected to the pair of slotted uprights 11, so that the shelflike component is thus positioned adjacent one side of the panel 10 and projects outwardly therefrom in a cantilevered relationship.

In the illustrated embodiment, the component 12 comprises a closed file cabinet of somewhat conventional construction in that it includes a pair of opposed end panels 13 which are joined together by a bottom wall or shelf 14, a back wall 16 and a top wall 17. These walls 13, 14, 16 and 17, in the preferred embodiment, are all constructed of a thin sheetlike metal plate and are suitably fixedly secured together to form a rigid boxlike housing which is open on the front side thereof. The cabinet 12 additionally has a movable or openable front cover or door 18 for closing off the front side of the cabinet housing, which cover is also preferably formed by inner and outer thin sheetlike metal plates having a core structure (such as a honeycomb layer) interposed therebetween for strength purposes. The cover or door 18 is attached to the cabinet housing by a conventional hinged telescopic ball-slide arrangement which includes a hinge 19 and a telescopic ball slide 21, the latter being supported on mounting brackets 22 secured to the inner sides of the end panels 13. This hinged ball slide arrangement 19, 21 enables the door 18 to be hinged upwardly (clockwise in FIG. 2) into a substantially horizontal position, and then slid rearwardly into a self-supporting storage position disposed within the cabinet directly below the top wall, substantially as illustrated by dotted lines in FIG. 2. Alternately, in many instances the hinged ball-slide arrangement 19, 21 is mounted on the upper side of the top wall 17 so as to enable the door 18 to be moved into an open storage position disposed above the top wall. These arrangements for mounting of the door and controlling the movement thereof into an open storage position are conventional and well known, and one example thereof is disclosed in U.S. Pat. No. 3,771,847.

While the component 12 is illustrated as a closed cabinet, it will be appreciated that numerous other types of components such as book shelves and lateral files can also be mounted on a wall panel in the same manner as the component 12, and hence the present invention is equally applicable to any such component as adapted for attachment to the side of a wall panel.

The attachment of component 12 to wall panel 10 is conventionally accomplished by providing a bracket which projects rearwardly from the rear edge of each end panel 13, which bracket conventionally employs a plurality of vertically spaced, downwardly projecting L-shaped hooks which project through the vertically spaced slots in the upright. For this purpose, the upright 11 has a narrow groove 23 which opens inwardly from the front wall 24 of the upright, with this groove 23 extending vertically along the height of the upright. This narrow groove 23 terminates in a rear wall 25 which is spaced rearwardly (i.e., inwardly) from the upright front wall 24. A plurality of slots 26 open rearwardly through this rear wall 25, the slots being disposed in substantially uniformly vertically spaced relationships along the groove so as to hence define a vertically extending row. Each of these slots 26 is horizontally narrow but vertically elongated. This slotted upright arrangement is also conventional.

Referring now to FIGS. 2–5, the present invention relates to an improved hanger bracket structure 30 which is secured to the end panel 13 and projects rearwardly thereof for attachment to the slotted upright 11. This bracket structure 30 includes upper and lower bracket parts 31 and 32 which are each adapted for engagement with the upright 11, with these bracket parts being disposed on vertically opposite sides of an intermediate locking part 33. The parts 31–33 are all associated with the rearward or free end of a spring part 34, with the latter being joined to a securing part 35 which rigidly attaches to the end panel 13. The bracket structure 30, including all of the parts 31–35, is preferably integrally formed in one piece of a thin sheetlike metal plate. Hence, the securing part 35 is thus a thin vertically enlarged plate which directly overlies and engages the inner surface of the end panel 13, with the securing part 35 being fixed to the end panel 13 by any conventional means, preferably by a plurality of spot welds 36. This securement of the bracket 30 to the end panel 13, by means of the securing part 35, occurs at a location which is spaced forwardly a substantial distance from the rear edge of the end panel.

Figure 3:
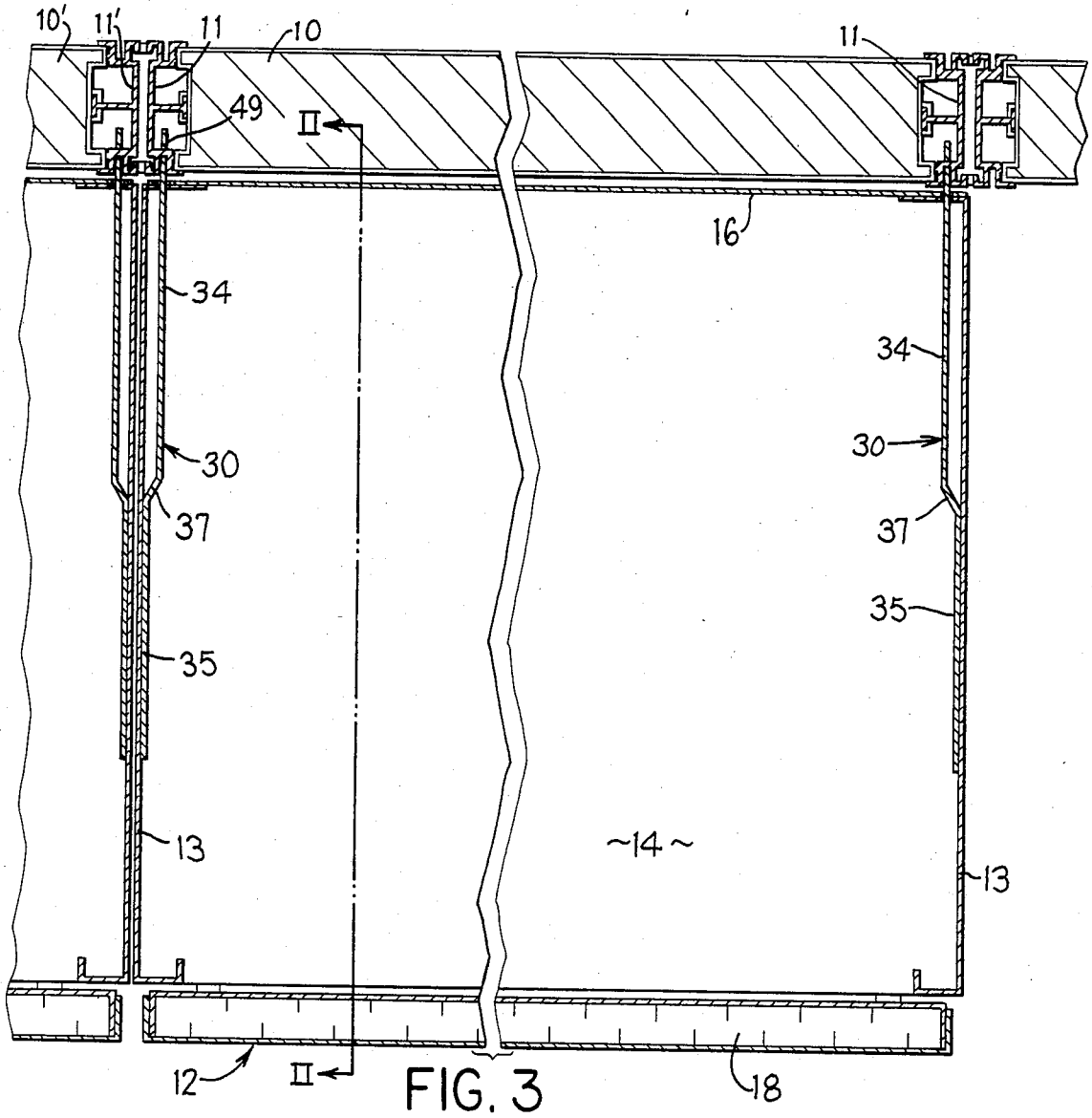
FIG.3 is a fragmentary sectional view taken substantially along line III—III in FIG. 2 and showing the cooperation of the cabinet with the upright wall panel.
Figure 5:
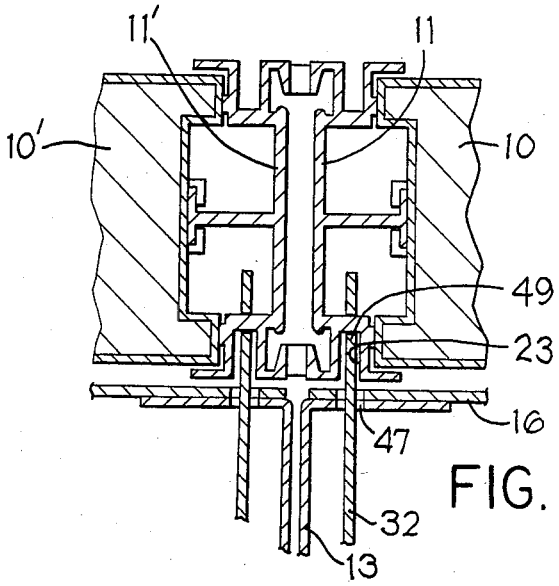
FIG. 5 is a fragmentary sectional view taken substantially along line V—V in FIG. 4. Certain terminology will be used in the following description for convenience in reference only, and will not be limiting. For example, the words "upwardly", "downwardly", "leftwardly" and "rightwardly" will refer to directions in the drawings to which reference is made. The words "upwardly" and "downwardly" will also be used with reference to the upper and lower ends of the bracket and of the associated cabinet and wall panel when oriented in the conventional operational position. The words "inwardly" and "outwardly" will refer to directions toward and away from, respectively, the geometric center of the cabinet and hanger brackets and associated parts thereof. Said terminology will include the words specifically mentioned, derivatives thereof, and words of similar import.
Figure 4:
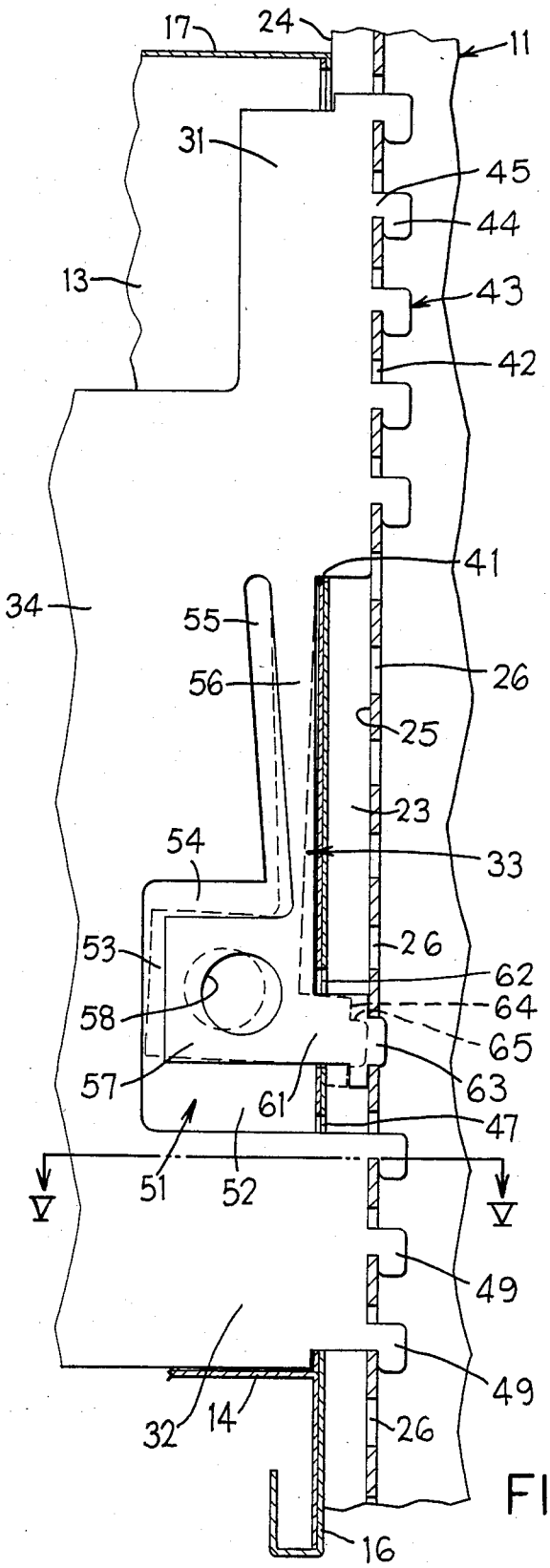
FIG. 4 is an enlarged, fragmentary, elevational, sectional view corresponding to the right side of FIG. 2 but showing the hanger bracket seated on the slotted upright.

The integral one-piece sheet metal bracket 30 also has a transition part 37 which integrally joins between the securing part 35 and the adjacent (i.e. forward) end of the spring part 34. This transition part 37 is bent so as to angle inwardly away from the securing part 35, and hence inwardly away from the end panel 13, as the part 37 projects rearwardly. This hence results in the spring part 34 being generally parallel with the securing part 35, and hence generally parallel with the end panel 13, but being spaced inwardly a small distance from the end panel so as to provide a small clearance space therebetween for enabling the spring part 34 to resiliently sidewardly deflect in the manner of a cantilever spring. This sideward offset between the parts 34 and 35 and their connection through the transition 37 hence results in the bracket 30 having generally Z-shaped configuration when viewed from above (FIG. 3).

The spring part 34 projects rearwardly from this transition 37 and terminates in a free or rearward edge 38 which is disposed closely adjacent the rear cabinet wall 16.

The upper bracket part 31 is, as noted above, integrally associated with the platelike spring part 34 adjacent the free or rearward end thereof. This upper bracket part 31 projects rearwardly beyond the rear edge 38 and, more specifically, projects through a vertically elongated slot 41 formed in the rear cabinet wall 16 so that the bracket part terminates in a rear edge 42 which is adapted to be positioned directly adjacent the rear wall 25 of the slotted upright when the bracket part is engaged therewith. This bracket part 31 also includes at least one, and preferably a plurality, of substantially identical L-shaped hooks 43 which project outwardly from the rear edge 42 in vertically spaced relationship. Each of these hooks 43 has an enlarged head part 44 which is of vertical dimension substantially equal to but slightly less than the height of a slot 26 so as to permit the head part 44 to pass horizontally therethrough. This head part 44 is spaced from the rear edge 42 by an intermediate downwardly-opening slot 46 which has a width approximately equal to but generally slightly greater than the width of the rear wall 25. A bridging part 45 integrally joins the upper end of the head part 44 to the rear edge 42 and closes off the upper end of the slot 46. These hooks 43 are hence substantially coplanar with the overall spring part 34, and the shape of these hooks and their cooperation with the slotted uprights is conventional.

The lower bracket part 32 is similarly constructed in that it is also of a generally thin sheetlike plate construction which is substantially coplanar with the spring part 34 and projects rearwardly therefrom, whereby this lower bracket part 32 projects through a further vertically elongated slot 47 formed in the rear cabinet wall 16 so as to terminate in a rear edge 48 which is substantially aligned with the rear edge 42 of the upper bracket part. The lower bracket part 32 again has at least one, and preferably a plurality, of L-shaped hooks 49 which project rearwardly and downwardly therefrom for cooperation with the slots 26 of the upright 11. These hooks 49 are identical to the above-described hooks 43.

Figure 2:
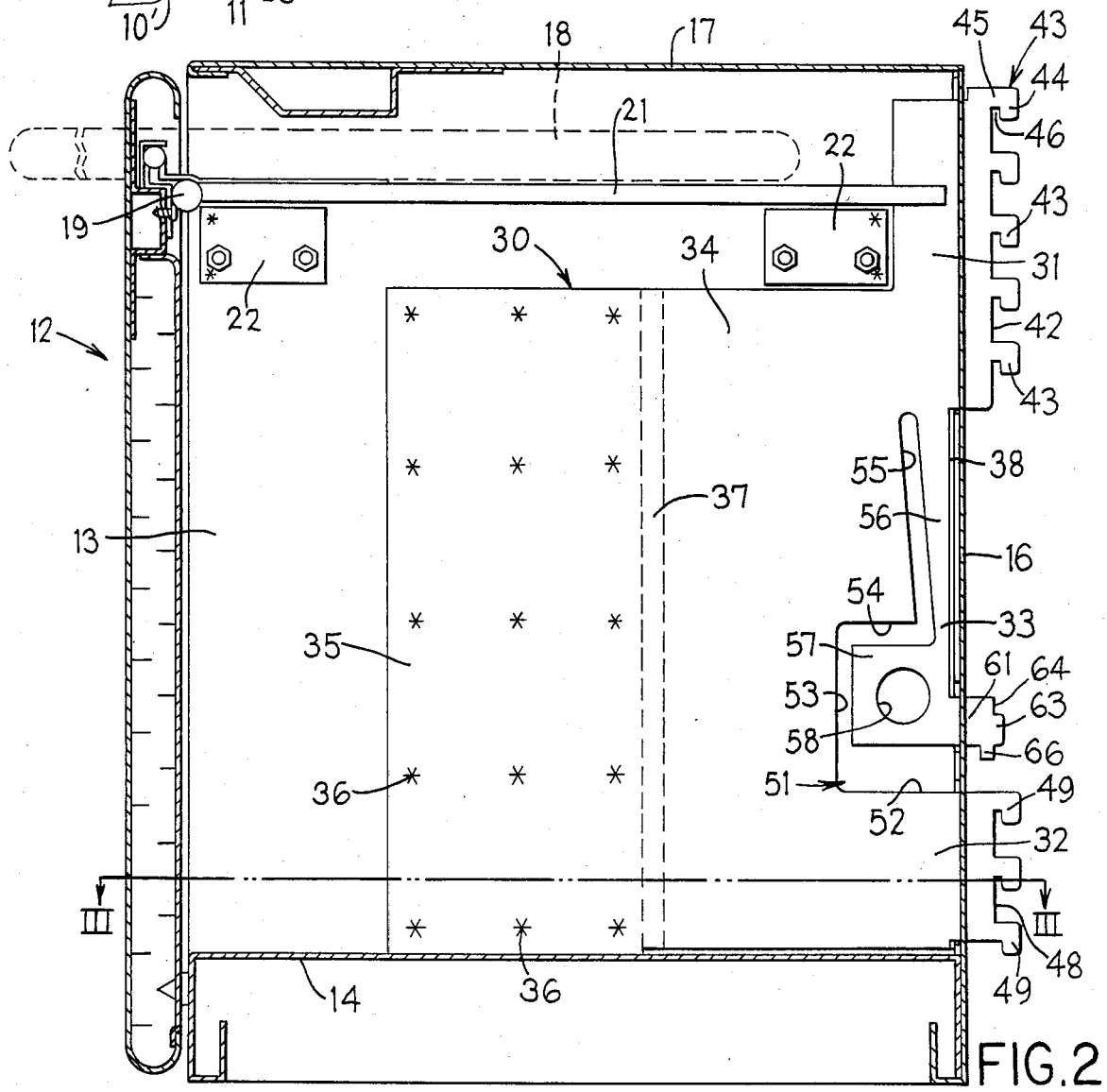
FIG. 2 is an enlarged sectional view transversely through the interior of the cabinet as taken substantially along line II—II of FIG. 3.

As illustrated by FIG. 2, the upper and lower bracket parts 31–32 project rearwardly from the rearward free end 38 of the spring part 34 and are disposed adjacent the upper and lower corners of the spring part so as to be vertically spaced. The locking part 33 is integrally associated with the spring part 34 intermediate the bracket parts 31 and 32.

This locking part 34 is disposed directly adjacent the rear edge 38 and is created by means of a slot arrangement 51 which is formed in the spring part 34 in communication with the rear edge 38. More specifically, this slot arrangement 51 includes a lower substantially horizontal portion 52 which projects inwardly in a forward direction from the rear edge 38. This lower portion communicates with an upwardly extending slot portion 53, and the latter in turn communicates with a substantially rearwardly and horizontally extending slot portion 54, the latter terminating short of the rear edge 38. This portion 54, at its rearward end, communicates with the lower end of an elongated upwardly extending slot portion 55, the latter terminating in a blind or closed upper end.

The slot arrangement 51 hence results in the defining of the locking part 33 as an integral portion of the spring part 34, with this locking part 33 including an elongated cantilevered spring lever 56 which is integrally joined to the spring part 34 at its upper end. This spring lever 56 projects downwardly in a cantilevered relationship, and the rearward side or edge of this lever 56 in effect defines a part of the rear edge 38 of the spring part 34. The lever 56 at its lower free end terminates in an enlarged grip portion 57 having a finger-receiving hole 58 therethrough, this latter hole 58 normally being aligned with a similar finger-receiving hole 59 (FIG. 1) formed in the adjacent end panel 13. These aligned holes 58 and 59 permit the installer to insert a finger therethrough so as to engage the grip portion 57 and hence permit resilient deflection of the locking part 33 into the released position illustrated by dotted lines in FIG. 4 when removal of the cabinet 12 from the wall panel 10 is desired. Alternately, the finger holes 58 and 59 could be smaller holes or slots designed to accommodate a small tool such as a screwdriver blade adapted for insertion therethrough for performing the same function.

The grip portion 57 of locking part 33 has a portion 61 which protrudes rearwardly therefrom through a vertically elongated slot 62 formed in the rear cabinet wall 16. This protruding portion 61 extends generally in perpendicular relationship to the elongated direction of the lever 56 so as to hence be movable in a generally forward-rearwardly direction relative to the spring part 34. This protruding portion 61 has a latching nose 63 which protrudes rearwardly from the rear edge 64. This latching nose 63 has a vertical height which closely equals the height of slot 26 so as to substantially fill the slot 26 when the nose 63 projects therein. Most significantly, however, is the fact that this nose 63 has an upper surface or shoulder 65 which is adapted to be disposed substantially directly under the upper edge of the slot 26 so as to prevent upward lifting of the bracket 30 relative to the slotted upright 11 when the nose 63 is engaged with its respective slot 26.

The protruding portion 61 also has a tab 66 which projects downwardly therefrom adjacent the free end thereof, this tab 66 being substantially aligned with the rear edge 64 and projecting downwardly from the nose 63, whereby rear edge 64 and tab 66 hence normally abuttingly engage the rear wall 25 due to the nose 63 being normally spring urged into engagement with a selected slot 26.

The operation of the improved bracket structure of this invention is believed obvious from the structural description described above.

When the cabinet 12 is to be attached to the wall panel 10, the cabinet 12 is positioned so that the bracket structures 30 associated with the opposite end panels 13 thereof are directly in front of the slotted uprights 11 located adjacent the opposite edges of the panel. The cabinet and hence the bracket structures are moved rearwardly into the grooves 23 so that the hooks 43 and 49 pass rearwardly through the slots 26. During this rearward passage of the hooks through the slots 26, the locking nose 63 is not aligned with the slots 26, but rather abuts the front face of the rear wall 25 and hence causes the locking part 33 to be deflected forwardly substantially into the position indicated by dotted lines in FIG. 4. Thereafter the entire cabinet 12 is forced downwardly so that the rear wall 25 enters into the hook slots 46 until the hooks are effectively properly seated due to substantial engagement between the briding portions 45 of the hooks and the lower ends of the slots 26. Substantially upon or shortly before reaching this seated position, the locking nose 63 has been moved down sufficiently as to substantially align with one of the slots 26, and hence the spring part 33 resiliently snaps rearwardly and causes the nose part 63 to enter into the respective slot 26 so that the shoulder 65 thereon is thus disposed directly below the upper edge of the respective slot 26. Hence, any tendency for the bracket 30, and hence the cabinet, to move upwardly relative to the upright is thus positively resisted due to the abutting engagement of the shoulder 65 against the upper edge of its respective slot 26. Accidental dislodgement of the cabinet from the uprights is hence positively prevented. Rather, if removal of the cabinet from the uprights is desired, the operator must insert a finger (or tool) through the openings 58 and 59 so as to resiliently deflect the spring part 33 forwardly (leftwardly in FIGS. 2 and 4) so as to withdraw the nose 63 from its respective slot 26 and, while maintaining the spring part in this withdrawn position, must then lift the cabinet 12 upwardly relative to the slotted uprights prior to releasing the spring part 33, following which the hooks can then be totally disengaged from the upright by forward displacement of the cabinet relative to the wall panel.

Alternately, and preferably, the hole 59 in the end panel is eliminated, and the operator accesses spring part 33 (and hole 58) by inserting his hand into the interior of the cabinet through the open front thereof.

If initial mounting of the cabinet on the wall panel is complicated due to improper alignment between the rearwardly protruding brackets 30 and the grooves 25, then this initial installation is greatly facilitated in the present invention inasmuch as each of the rearwardly protruding brackets can be readily sidewardly deflected either inwardly or outwardly relative to its adjacent end panel merely by applying an appropriate side pressure to the spring part 34 in the selected sideward direction so as to cause the rearwardly protruding hooks 43 and 49 to enter into the groove 23 and thence through the slots 26. The appropriate deflecting pressure for the spring part 34 can be applied at many different locations, such as from internally of the cabinet or by engaging either the upper or lower bracket part externally of the cabinet, either by use of the fingers or an appropriate tool, with the applied sideward pressure causing proper sideward deflection of both the upper and lower bracket parts while at the same maintaining proper alignment thereof with respect to one another.

The resulting bracket 30 of this invention, and its manner of construction, is also desirable in that it can be positioned directly adjacent the inner side of the appropriate end panel 13 without requiring any additional inner covering wall since the configuration of bracket 30 does not significantly detract from the interior appearance of the cabinet, and does not interfere with the storing of goods within the cabinet due to the substantially smooth and planar configuration of the bracket 30.

As to the specific configuration of the hooks 43 and 49, and their cooperation with the slotted wall 25, the hooks may have a configuration similar to that as described in aforementioned Pat. No. 4,222,542.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, a shelflike furniture component having a pair of horizontally spaced vertically-extending end panels each having a vertically extending rear edge, a bracket structure fixed to each end panel and projecting rearwardly from the rear edge thereof, and a pair of substantially parallel uprights each having a row of vertically spaced elongated slots formed in a wall thereof for engagement with said bracket structures to thereby fixedly mount said furniture component on said uprights in a cantilievered relationship, each said bracket structure including a plurality of rearwardly-projecting downwardly-opening L-shaped rigid hooks disposed in vertically spaced relationship and being insertable through individual slots formed in the respective upright for fixedly attaching the furniture component to the uprights, the improvement wherein at least one of said bracket structures comprises:

a one-piece bracket member fixedly attached to said end panel and projecting rearwardly thereof, said one-piece bracket member being formed from a thin sheetlike metal plate of substantially uniform thickness, said sheetlike metal plate being substantially vertically oriented and positioned in close proximity to the respectively adjacent end panel;

said bracket member having a front part which is of a generally vertically-oriented platelike configuration which directly overlies and is fixedly secured to the respectively adjacent end panel at a location which is spaced forwardly a substantial distance from said rear edge;

said bracket member having a transition part which is integrally fixed to a rearward end of said front part and projects horizontally sidewardly therefrom in a direction away from said adjacent end panel, said transition part being spaced forwardly a substantial distance from said rear edge;

said bracket member including a horizontally-elongated cantilvered spring part of a generally vertically-oriented platelike configuration which is fixed to and projects rearwardly from the transition part in approximately parallel relationship to the adjacent end panel, the spring part being sidewardly spaced from the adjacent end panel by a small clearance space therebetween so that the spring part can be resiliently horizontally sidewardly deflected in either direction relative to the adjacent end panel substantially about the transition part, said spring part termianting in a free end which is located in the vicinity of said rear edge;

said spring part in the vicinity of the free end thereof defining thereon said plurality of rearwardly-projecting L-shaped rigid hooks, said hooks projecting outwardly beyond said free end and being substantially vertically coplanar with said spring part;

whereby the hooks associated with said one bracket structure can be sidewardly resiliently displaced relative to the respectively adjacent end panel and relative to the other bracket structure so as to permit the bracket structures to properly sidewardly align with the slots in the uprights.

2. A combination according to claim 1, wherein said one-piece bracket member includes a vertically spaced upper and lower bracket parts which are coplanar and integral with said spring part and which project rearwardly of said spring part beyond the rearward free end thereof, each of said upper and lower bracket parts having at least one of said L-shaped hooks projecting rearwardly therefrom for engagement with the respective slotted upright.

3. A. combination according to claim 2, wherein said one-piece bracket member has a locking part integrally formed on said spring part adjacent the free end thereof and normally spring-urged rearwardly for engagement with one of the slots when the bracket member is properly engaged with and seated on the slotted upright, said locking part being vertically disposed between said upper and lower bracket parts.

4. A combination according to claim 2, wherein said locking part includes a vertically-elongated cantilevered spring finger which is formed integrally with said spring part directly adjacent the free end thereof, said spring finger being integrally joined at one end thereof to said spring part and being free at the other end thereof, said spring finger at said other end having a rearwardly protruding portion which protrudes outwardly beyond said rear edge and is substantially vertically aligned with said hooks so as to be insertable into one of said slots directly below an upper edge thereof when said hooks are properly seated within others of said slots, said spring finger being resiliently deflectable in a forward direction relative to said spring part when the bracket member is being mounted on or removed from the slotted upright.

5. A combination according to claim 4, wherein said spring part has a slot which opens forwardly from the free end thereof and then projects vertically so as to terminate at a blind end, whereby said slot cooperates with said free end so as to define the cantilevered spring finger therebetween.

6. A combination according to claim 1, wherein the other said bracket structure as secured to the other end panel is substantially identical to said one bracket structure.

7. A combination according to claim 1, wherein said spring part has a resilient cantilevered locking finger integrally associated therewith adjacent the free end thereof, said locking finger being generally coplanar with the spring part and cantilevered vertically therefrom so that the free end of said spring finger can be resiliently deflected generally horizontally substantially within the plane of the spring part in a substantially front-to-rear direction, said spring finger adjacent the free end thereof having a rearwardly protruding locking part adapted to protrude into one of the slots of said upright only when the L-shaped hooks are properly engaged with and seated on the upright.

8. A combination according to claim 1, wherein each said bracket member is disposed adajcent and is fixedly attached to an inner side surface of the respectively adjacent end panel, said furniture component having a vertically-extending rear wall which extends horizontally between the rear edges of said end panels, said rear wall having a narrow but vertically elongated slot opening through said rear wall in the vicinity of each said end panel, said hooks projecting rearwardly through said slot, said slot having a width which is significantly greater than the thickness of the spring part for enabling the latter to be resiliently sidewardly deflected in either direction.

9. A combiantion according to claim 1, wherein the thin sheetlike metal plate defining said one-piece bracket member has a generally rectangular vertically-oriented configuration so that the front part, the transition part and the spring part all extend vertically over a majority of the vertically extent of the respectively adjacent end panel, and the spring part of said one-piece bracket member having vertically-spaced upper and lower bracket parts which are coplanar and integral therewith and which project rearwardly of said spring part beyond the free end thereof, each of said upper and lower bracket parts having at least one of said L-shaped hooks projecting rearwardly therefrom for engagement with the respective slotted upright, and locking part integrally formed on said spring part adjacent the free end thereof and being normally spring-urged rearwardly for engagement with one of the slots in the respective upright when the bracket parts are properly engaged with and seated on the slotted upright, said locking part comprising a vertically-elongated cantilevered spring finger formed integrally with said spring part directly adjacent said free end.

10. In a shelflike furniture component having a pair of horizontally spaced vertically-extending end panels which are fixedly secured to and project upwardly from opposite ends of a horizontally-elongated support shelf, each said end panel having a vertically extending rear edge, a bracket structure fixed to each said end panel and projecting rearwardly from the rear edge thereof for releasable engagement with a substantially vertically-extending upright having a row of vertically spaced elohngated slots formed therein to enable the furniture component to be fixedly mounted on a pair of said uprights in cantilevered relationship thereto, each said bracket structure including a plurality of rearwardly-projecting downwardly-opening L-shaped rigid hooks disposed in vertically spaced relationship and being insertable through individual slots formed in the respective upright for fixedly attaching the furniture component thereto, the improvement wherein the bracket structure as associated with each said end panel comprises:

a one-piece bracket member fixedly attached to an inside surface of a respective said end panel and projecting rearwardly thereof, said one-piece bracket member being formed from a thin sheetlike metal plate of substantially uniform thickness, said sheetlike metal plate being substantially vertically oriented and positioned in close proximity to the inside surface of the respectively adjacent end panel;

said bracket member including a front part which overlies and is fixedly secured to a respectively adjacent said end panel at a location spaced forwardly a substantial distance from the rear edge thereof;

said bracket member including a horizontally elongated cantilevered spring part which is integrally joined at its forward end through a sideward offset part to said front part so that the spring part is spaced sidewardly from the adjacent end panel by a small clearance space therebetween, the spring part projecting horizontally rearwardly from the offset part in cantilevered relationship so as to terminate in a rearward free end which is located in the vicinity of said rear edge;

said spring part in the vicinity of said rearward free end defining thereon said plurality of rearwardly projecting L-shaped rigid hooks, said hooks being substantially vertically coplanar with said spring part;

the spring part associated with one said bracket structure being sidewardly resilient displaceable relative to the respectively adjacent end panel and relative to the other bracket structure so as to permit the hooks thereon to be properly sidewardly aligned with the slots in the upright.

11. A furniture component according to claim 10, wherein the thin sheetlike metal plate defining said one-piece bracket member has a generally enlarged and vertically-oriented rectangular configuration so that both the front and spring part extend vertically over a majority of the vertical extend of the respectively adjacent end panel, and wherein said platelike member defining said one-piece bracket member also extends horizontally over a majority of the horizontal extent of the respectively adjacent end panel.

12. A furniture component according to claim 11, wherein said one-piece bracket member includes vertically spaced upper and lower bracket parts which are coplanar and integral with said spring part and which project rearwardly of said spring part beyond the rearward free end thereof, each of said upper and lower bracket parts having at least one of said L-shaped hooks projecting rearwardly therefrom for engagement with the respective slotted upright.

13. A furniture component according to claim 12, wherein the spring part of said bracket member has a resilient-deflectable elongated leverlike cantilevered spring finger integrally joined to said spring part adjacent the rearward free end thereof and disposed for engagement with one of the slots in the upright when the L-shaped hooks associated with said bracket parts are properly seated within said slots.

* * * * *

UNITED STATES PATENT AND TRADEMARK OFFICE

CERTIFICATE OF CORRECTION

PATENT NO. : 4 733 841

DATED : March 29, 1988

INVENTOR(S) : Harold R. WILSON

It is certified that error appears in the above-identified patent and that said Letters Patent is hereby corrected as shown below:

Column 8, Line 57; Change "termianting" to ---terminating---.

Column 9, Line 4; After "includes" insert ---a---.

Column 9, Line 20; Change "2" to ---3---.

Column 10, Line 9; Change "vertically" to ---vertical---.

Column 10, Line 17; Change "and locking" to ---and a locking---.

Column 10, Line 36; Change "elohngated" to ---elongated---.

Column 11, Line 9; Change "resilient" to ---resiliently---.

Column 11, Line 18; Change "part" to ---parts---.

Column 12, Line 15; Change "resilient-deflectable" to ---resiliently-deflectable---.

Signed and Sealed this

Eighth Day of November, 1988

*Attest:*

DONALD J. QUIGG

*Attesting Officer*

*Commissioner of Patents and Trademarks*